United States Patent [19]

Gunton et al.

[11] 4,027,254

[45] May 31, 1977

[54] DIRECTIONAL COUPLER HAVING INTERDIGITAL COMB ELECTRODES

[75] Inventors: David John Gunton; Edward George Sydney Paige, both of Malvern, England

[73] Assignee: The Secretary of State for Defence in Her Britannic Majesty's Government of the United Kingdom of Great Britain and Northern Ireland, London, England

[22] Filed: Jan. 30, 1976

[21] Appl. No.: 653,861

[30] Foreign Application Priority Data

Feb. 11, 1975 United Kingdom ..... 5839/75
Mar. 10, 1975 United Kingdom ..... 9920/75

[52] U.S. Cl. ..... 333/10; 325/446
[51] Int. Cl.² ..... H01P 5/18
[58] Field of Search ..... 333/10

[56] References Cited

UNITED STATES PATENTS

| | | | |
|---|---|---|---|
| 3,516,024 | 6/1970 | Lange | 333/10 |
| 3,593,208 | 7/1971 | Smith | 333/10 |
| 3,629,733 | 12/1971 | Podell | 333/10 |

*Primary Examiner*—Paul L. Gensler
*Attorney, Agent, or Firm*—Pollock, VandeSande & Priddy

[57] ABSTRACT

A directional coupler comprising a dielectric substrate having two opposing faces carrying a sheet electrode on one face and two comb like electrode structures on the other face. Each comb electrode has finger like electrodes projecting from a bus bar towards the other comb. Varying the length of finger electrodes and the amount of overlap varies the amount of signal power coupled between the two combs. Couplers may be arranged to couple up to 100% of signal power. When half signal power is coupled, a 3dB coupler, various microstrip circuits may be built e.g. balanced mixers, power dividers, or power combiners.

6 Claims, 6 Drawing Figures

DIRECTIONAL COUPLER HAVING INTERDIGITAL COMB ELECTRODES

This invention relates to directional couplers formed in microstrip or stripline. Such construction involves use of thin strip electrodes on the flat faces of a dielectric substrate.

One microstrip arrangement comprises a dielectric flat substrate with a ground plane electrode covering one surface and with a narrow strip electrode on the other face. An electromagnetic wave signal applied between the ground and the strip electrode is transmitted along the strip.

One known form of strip line directional coupler comprises two strips of a conductor arranged parallel to one another on the same surface of an insulating substrate. Provided the conductor spacing and length of the coupled system is correct power will be transferred from one strip to the other over a particular frequency range. Such a coupler is termed an edge coupled microstrip directional coupler.

A disadvantage with this edge coupled microstrip coupler is the accuracy required in spacing the parallel electrodes and in dimensioning the strips to ensure the desired amount of coupling.

According to this invention a directional coupler comprises a dielectric substrate having two opposing faces, a ground sheet electrode on one face of the substrate, and two spaced, electrically isolated comb electrodes on the other face of the substrate arranged so that a portion of a signal power may be capacitively coupled from one comb to the other.

The invention will now be described by way of example only with reference to the accompanying drawings in which.

Figure 1:
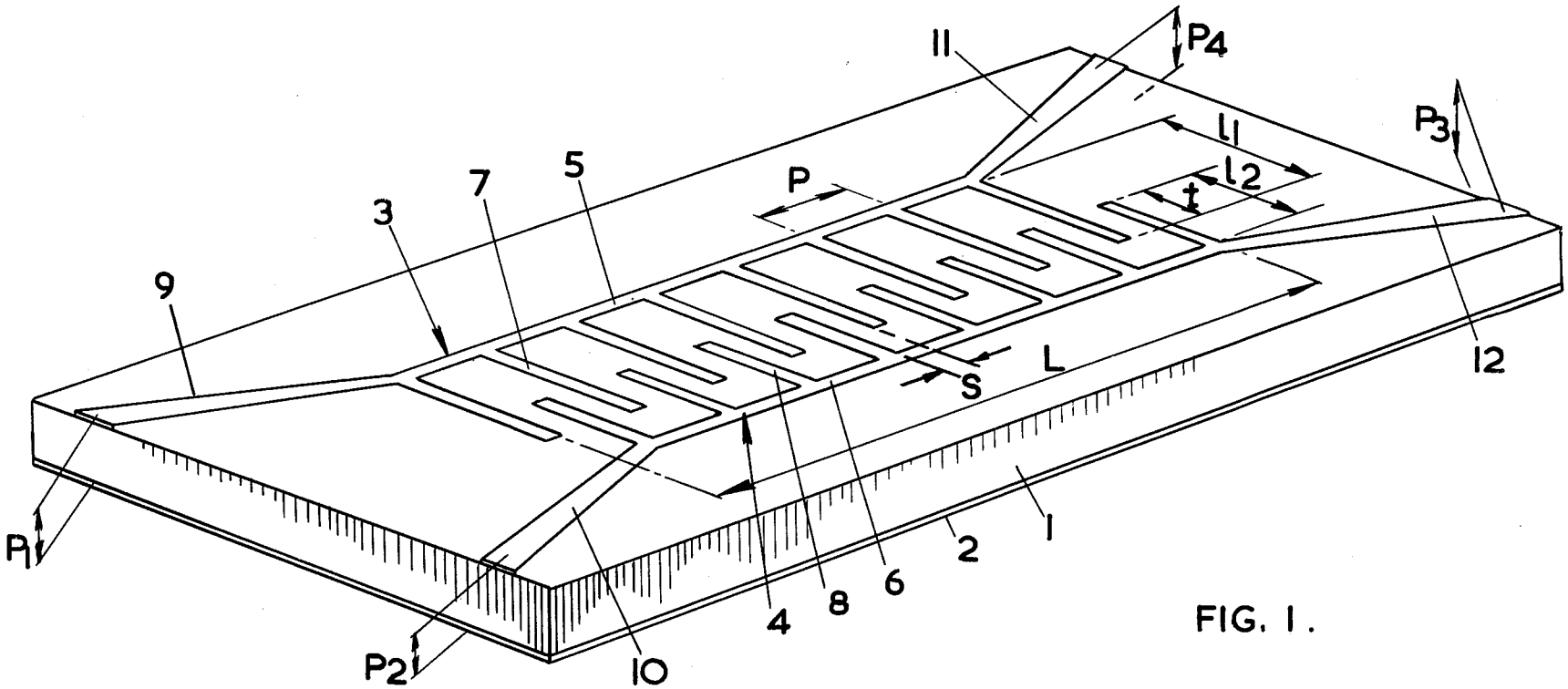
FIG. 1 is a perspective view of one form of the invention.

The directional coupler shown in FIG. 1 comprises a flat substrate 1 of polyolefin material e.g. Polyguide (Trade Mark) covered on one face with a ground or earth sheet copper electrode 2 and carrying on its opposite face two interdigital comb-like copper electrode structures 3, 4. These structures 3, 4, each comprise a bus bar 5, 6 with fingers or stubs 7, 8 projecting normal thereto. It can be seen that the fingers 7, 8 in the two combs 3, 4 are interdigital and equispaced. Lead strips 9, 10, 11, 12, connect the combs to ports $P_1$ $P_2$ $P_3$ $P_4$, so that an input (or output) signal may be applied between strip 9 and the ground plane at port $P_1$, etc.

The two comb structures can be considered to be a four port coupled transmission line system having two modes of propagation. The behaviour of this transmission line is dependent on the dimensions (and impedance) of the two combs 3, 4. Let the length of the interdigital combs 3, 4 be L, the length of fingers in one comb 3 be $1_1$ and in the other comb 4 be $1_2$, the finger overlap be t, the spacing of adjacent fingers be s, and the fingers on each comb be spaced p apart.

Figure 2:
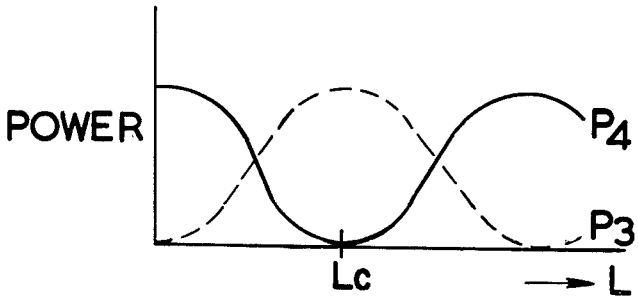
FIGS. 2, 3, 4, 5 are graphs showing power transfer in the coupler.

If $1_1 = 1_2$, i.e. the combs are symmetric, and a constant frequency signal is applied to input port $P_1$, then the output at ports $P_3$ and $P_4$ for various values of comb length will be as shown in FIG. 2, neglecting losses due to radiation resistance, reflection and dielectric absorption. At a point marked $L_c$ all power has been transferred from comb 3 to comb 4, i.e. there is zero output at $P_4$ and all power is at $P_3$.

Figure 3:
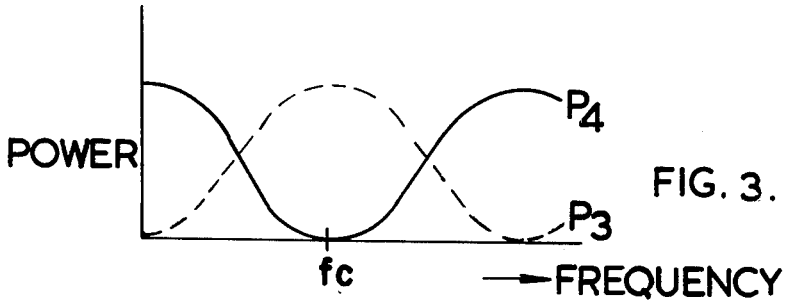

For a given length L, varying the input signal frequency results in varying amounts of power being transferred to output ports $P_3$, $P_4$ as shown in FIG. 3. Maximum transfer from input port $P_1$ to output port $P_3$ occurs at a center frequency $f_c$.

The theoretical basis for this (when $1_1 = 1_2$) is as follows. A general signal applied to input port $P_1$ only can be analyzed in terms of the symmetric and antisymmetric modes of propagation. At any point along the combs 3, 4 there will be a phase difference between the modes on account of their different velocities, and the energy distribution between the combs 3, 4 at that point is given by $(1-\cos\phi)/(1+\cos\phi)$ where $\phi$ is the phase angle between the two modes. Thus there is a periodic transfer of energy from one comb to the other comb, with maximum transfer occurring when $\phi = \pi$. This transfer is periodic in length at a given frequency (FIG. 2) and, for a dispersionless system, periodic in frequency for a given length L (FIG. 3).

Figure 4:
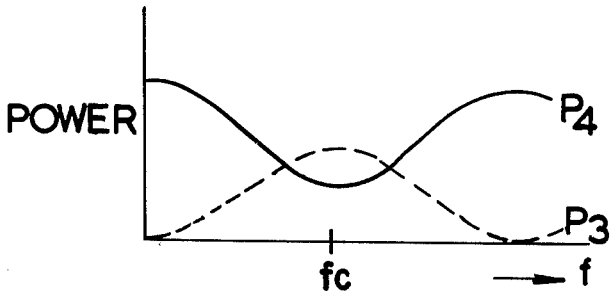
Figure 5:
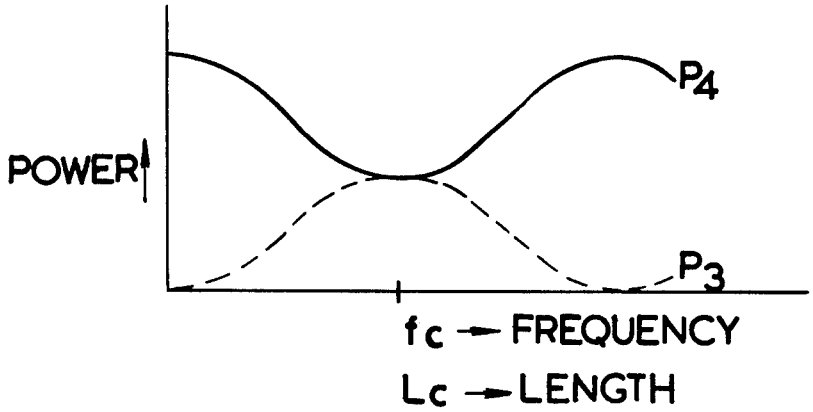

For the case where $1_1$ $1_2$ then the modes become unbalanced and the maximum power transferred is less, (FIG. 4). By choice of L, $1_1$ and $1_2$ the amount of power transfer can be made equal to ½ i.e. a 3dB transfer in which case the two curves of FIG. 4 just touch as shown in FIG. 5. Thus power applied to input port $P_1$ is split equally between output ports $P_3$ and $P_4$ with zero signal (in theory) at port $P_2$.

For a given length L and frequency $f_c$ the amount of coupling between combs varies with finger overlap $t$.

As already noted behaviour of the coupled transmission line is dependent on the physical characteristic of the two combs 3, 4. The frequency of operation is governed by the various stop bands arising from the periodic impedance mismatches and resonance effects due to the spacing $s$, $p$ and length of the fingers 7, 8.

Thus for example a coupler can be constructed so that the first resonance band occurs when $1_1 = \lambda/4$ i.e. a lower frequency than that of the stop band which occurs when the distance P between adjacent fingers on one comb $= \lambda/2$, $\lambda$ being wavelength.

A broad band coupling has been found in a coupler of this invention when the frequency of operation $f_o$ is about half that frequency at which $\lambda/4$ resonance occurs in the length of the fingers i.e. when $1_1$ is approximately $\lambda_c/8$ where $\lambda_c$ is the wavelength at the center frequency $f_c$. In such an example a flat bandwidth of about $f_c \pm 20\%$ may be achieved.

As an example a broadband 3dB coupler has been constructed to operate over the frequency range 5.3 to 6.6 $GH_z$ and had the following dimensions L = 32mm, $1_1$ = 5mm, $1_2$ = 4mm, P = 4 mm, s = 1 mm, finger overlap $t$ = 2mm, width of bus bars = 1mm, thickness of electrodes = 0.035mm, substrate = 1.6mm thick Polyguide (Trade Mark).

In another variation the electrode assembly of FIG. 1 may be covered with another sheet of dielectric, itself backed with a ground sheet electrode. This arrangement is useful for reducing radiation losses, especially with low dielectric constant substrates, and constitutes a triplate or stripline configuration. For this case the exact dimensions of the comb electrodes may differ from those for the open, or microstrip, variation for the same coupling value.

As another example a 10 GHz 3dB coupler has been built in a triplate configuration and had the following dimensions: L = 28mm, $1_1$ = 2.3mm, $1_2$ = 0.9mm, $p$ =

2.4mm, $s = 0.6$mm, width of bus bar 5 = 0.8mm, width of bus bar 6 = 1.0mm, thickness of dielectric 1 = 1/16 inch and dielectric constant = 2.4.

The various parameters to be considered in designing the coupler are therefore:

- ratio $l_1/l_2$ - which sets maximum power transfer between combs
- $l_1$ - sets the first cut off frequency
- $t$, $s$ - the coupling coefficient depends on $t$, $s$; the coupling coefficient in turn affects the value of $f_c$ for a given L
- L - sets the device center frequency
- width of bus bars affects the input impedance and hence the matching conditions.

The finger lengths $l_1$, $l_2$ may be constant, as shown, or may vary along the coupler length. Also the finger separation $p$, $s$ may be constant or varying. The finger overlap $t$ may be positive as shown, zero, or the combs may be further still apart in which case there will be a gap between the two combs i.e. a negative value of $t$. The two combs of a coupler may be spaced parallel apart or at a varying distance apart.

As shown in FIG. 1 a coupler comprises a substrate with four ports $P_1$, $P_2$, $P_3$, $P_4$ to which other devices (e.g. coaxial lines) may be attached. In practice the coupler shown may be a part of a much larger strip line circuit. Matching in to the coupler from the input and output lines is by tapered sections of transmission line.

For a coupler having symmetric combs $l_1 = l_2$, for an input to port $P_1$ the outputs at $P_3$, $P_4$ will be 90° out of phase, for any comb length not just $L_c$. However for non-symmetric combs, $l_1 \neq l_2$, the phase between outputs $P_3$, $P_4$ is not 90°. If a 90° phase is required, one of the lead electrodes e.g. at $P_3$ may include a section of comb line whose dispersive characteristics are such that the phase variation between $P_3$ and $P_4$ is reduced to that desired.

In a 3dB coupler signals at the output ports $P_3$, $P_4$ are either out of phase or in phase depending on the input port used. When a signal is applied to input port $P_1$ only, the phase difference between signals at $P_3$ and $P_4$ is 180°. When a nonsymmetric comb structure is employed and a signal is applied to input port $P_2$ only, the signals at output ports $P_3$, $P_4$ are in phase. Such a phase relation occurs at the center frequency $f_c$; at frequencies away from $f_c$ this phase relationship varies linearly with variation from $f_c$.

Uses of such a 3dB coupler include in-phase signal power dividers, i.e. signal input to $P_2$; out of phase signal power dividers i.e. signal input to $P_1$; power combiner i.e. two equal in-phase signals one applied to $P_1$ the other to $P_2$ and power out of $P_3$.

Figure 6:
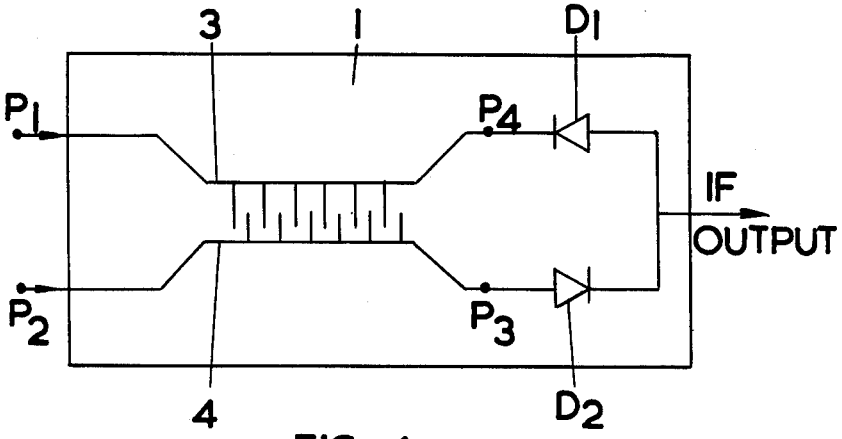
FIG. 6 is a diagrammatical view of a balanced mixer.

Another use of a 3dB coupler is shown diagrammatically in FIG. 6 having identical reference characters as FIG. 1. Additionally it comprises two microwave diodes $D_1$, $D_2$ connected to the outputs $P_3$ $P_4$ and to a common IF output and forms a balanced mixer. A d.c. bias is applied to the diodes from a voltage source not shown. A signal from a local oscillator is applied to input port $P_1$ and a modulated signal applied to input port $P_2$.

In operation the coupler splits the local oscillator power out of phase and the received power in phase. The signals are mixed by the diodes to provide an IF signal. The local oscillator noise cancels on recombination at the diode outputs.

I claim:

1. A directional coupler comprising a dielectric substrate having two opposing faces, a ground sheet electrode on one face of said substrate, first and second elongated bus bars disposed in spaced relation to one another on the other face of said substrate, a first series of finger electrodes extending from said first bus bar at spaced locations distributed along substantially the entire length of said first bus bar, said first series of finger electrodes being disposed transverse to the direction of elongation of said first bus bar and projecting therefrom toward said second bus bar, a second series of finger electrodes extending from said second bus bar at spaced locations distributed along substantially the entire length of said second bus bar, said second series of finger electrodes being disposed transverse to the direction of elongation of said second bus bar and projecting therefrom toward said first bus bar, said first bus bar and its respective first series of finger electrodes being separated from said second bus bar and its respective second finger electrodes to form first and second electrically isolated interdigital comb structures which are capacitively coupled to one another, means providing an input port and an output port for each of said comb structures, said input and output ports being disposed at opposite ends of each of said bus bars respectively for applying signals to and extracting signals from the coupler, the two output ports for said two comb structures being located at adjacent ends of said first and second bus bars respectively, whereby a proportion of signal power applied to the input port at one end of one of said comb structures is coupled to the remote output port at the other end of the other comb structure.

2. A coupler according to claim 1 wherein the finger electrodes in each comb structure are of uniform length.

3. A coupler according to claim 1 wherein the finger electrodes on one comb structure are longer than the finger electrodes on the other comb structure.

4. A coupler according to claim 1 wherein the coupler is arranged to couple about one half the signal power from one comb structure to the other.

5. A coupler according to claim 1 and comprising a further substrate having two opposing faces, one carrying a further sheet electrode and the other being in contact with said two comb structures.

6. A coupler according to claim 1 wherein the two spaced bus bars are parallel to one another.

* * * * *